US005718082A

United States Patent [19]

Mori

[11] Patent Number: 5,718,082

[45] Date of Patent: Feb. 17, 1998

[54] DOOR APPARATUS

[75] Inventor: Toshiaki Mori, Yokohama, Japan

[73] Assignee: Abe Kogyo Co., Ltd., Tokyo, Japan

[21] Appl. No.: 701,119

[22] Filed: Aug. 21, 1996

[51] Int. Cl.[6] ..... E06B 1/00

[52] U.S. Cl. ..... 49/380; 206/325

[58] Field of Search ..... 49/380, 501, 504; 206/321, 325

[56] References Cited

U.S. PATENT DOCUMENTS

| | | | |
|---|---|---|---|
| 2,929,495 | 3/1960 | Simonsen | 206/325 |
| 4,483,101 | 11/1984 | Berzina | 49/380 |
| 4,850,141 | 7/1989 | Pacca | 49/380 |
| 4,967,905 | 11/1990 | Steves | 206/325 X |
| 5,209,017 | 5/1993 | Ridge | 49/380 |
| 5,365,697 | 11/1994 | Vanderpan | 49/380 |
| 5,562,315 | 10/1996 | Sales | 49/380 X |

*Primary Examiner*—Jerry Redman

*Attorney, Agent, or Firm*—Frishauf, Holtz, Goodman, Langer & Chick

[57] ABSTRACT

A first vertical frame of a frame structure is supported on one side portion of a door by hinges. A latch tacker is attached to a strike that is provided on a second vertical frame of the casing. The latch tacker has a shape such that a latch bolt of a lock body on the door can be held at least from both above and below. A latch bolt receiving aperture is formed in the latch tacker. The latch tacker is fitted into the strike, and the latch bolt is inserted into the latch bolt receiving aperture, whereupon the second vertical frame is supported on the other side portion of the door by the latch tacker.

7 Claims, 6 Drawing Sheets

DOOR APPARATUS

BACKGROUND OF THE INVENTION

1. Field of the Invention

The present invention relates to a door apparatus adapted to be installed in a building or the like, and more particularly, to a door apparatus including a frame structure and a door.

2. Description of the Related Art

FIG. 10 shows an example of a conventional interior door apparatus that can be installed at the entrance of a room in a building or the like. This door apparatus comprises a frame structure 1, fixed to the inner peripheral surface of a door opening in a building, wall, and a door 11 attached to the frame structure 1. The frame structure 1 includes a pair of vertical frames 2*a* and 2*b*, right and left, and an upper frame 2*c* connecting the respective upper ends of the frames 2*a* and 2*b*. One side portion of the door 11 is pivotally supported on the first vertical frame 2*a* by means of hinges 10 in two positions, upper and lower. The door 11 can be swung open on this side of FIG. 10. The lower end portion of each vertical frame extends below the lower edge of the door 11. The respective lower ends of the vertical frames 2*a* and 2*b* are connected by means of a waste frame 3. Each vertical frame is cut to a length H that is equal to the height of the door opening.

A lock body 12 having a latch bolt 12*a* is provided on the other side portion of the door 11. Unlocking handles 20*a* and 20*b* are attached to the outside and inside of the door 11, respectively. An unlocking shaft 21 attached to the one handle 20*a* is passed through a through hole 13 in the door 11. The through hole 13 is located in alignment with a shaft hole (not shown) in the lock body 12.

The second vertical frame 2*b* is provided with a strike 15. The strike 15 is situated in a position such that it can engage the latch bolt 12*a*, which can project and recede from a side face of the door 11, and has a latch retaining aperture in which the latch bolt 12*a* can be fitted. The vertical opening width of the latch retaining aperture is greater enough than the vertical dimension of the latch bolt 12*a* to allow the bolt 12*a* to be fitted in the retaining aperture even though the attached strike 15 is vertically dislocated in some measure with respect to the frame structure 1.

In shipping the door apparatus, the door 11 is closed with respect to the frame structure 1, and the latch bolt 12*a* is caused to engage the strike 15. Further, the door apparatus is packed up with the lower edge of the door 11 supported by a pillar-shaped spacer 4 on the waste frame 3, and is then shipped together with its accessories. The accessories include doorstops (not shown) for bearing the door 11 from behind, front and back curbs, etc., as well as the handles 20*a* and 20*b*.

In general, the door apparatus is set in the door opening in the building wall in the following processes. First, the door 11 is disengaged from the frame structure 1 by separating the hinges 10 on the door 11 from the hinges 10 on the frame structure 1. Thereafter, the lower end portion of each of the vertical frames 2*a* and 2*b* is cut off along dashed line A in FIG. 10, depending on the height of the door opening. Then, the frame structure 1 is fitted into the door opening and positioned. After a liner is driven into the gaps between the respective outer surfaces of the frames 2*a*, 2*b* and 2*c* and the inner peripheral surface of the door opening, the frame structure 1 is fixed to the inner peripheral surface of the door opening by means of wood screws or nails.

Thereafter, the hinges 10 on the frame structure 1 and the door 11 are connected to one another. Also, the doorstops are attached individually to the respective inner surfaces of the frames 2*a*, 2*b* and 2*c*, and the front and back curbs are attached to the frame structure 1 or the inner peripheral edge of the door opening. After the unlocking shaft 21 of the one handle 20*a* is passed through the through hole 13 in the door 11, a handle seat 22*a* is screwed to the door 11. In this manner, the one handle 20*a* is attached to one surface side of the door 11. The other handle 20*b* is fitted onto the unlocking shaft 21 from the other surface side of the door 11, and a handle seat 22*b* is screwed to the door 11.

In setting the conventional door apparatus in the door opening, as described above, the door 11 must be disengaged from the frame structure 1. After the frame structure 1 is fixed to the door opening, moreover, the door 11 must be attached again to the frame structure 1. Thus, the installation of the door apparatus requires much time and labor.

Since the frame structure 1 of the door apparatus is designed so as to be supported by the inner peripheral surface of the door opening, its strength is not very high. In the door apparatus of this type, the waste frame 3 is removed after the lower end portions of the vertical frames 2*a* and 2*b* are cut off, so that the frame structure 1 is liable to be distorted. If an attempt is made to set the apparatus in the door opening with the door 11 attached to the frame structure i, therefore, the frame structure 1 is inevitably distorted by the weight of the door 11 during operation. Since the first vertical frame 2*a* and the door 11 are connected to each other by means of the hinges 10, their relative positions cannot be changed. On the other hand, the second vertical frame 2*b* is independent of the door 11. If the frame structure 1 is placed upright on a floor or lifted up, therefore, the door 11 is dislocated downward with respect to the second vertical frame 2*b* by its own weight, and the upper frame 2*c* inclines, as indicated by dashed line in FIG. 10. In the illustration of FIG. 10, the distortion of the frame structure 1 is exaggerated. Actually, the frame structure 1 is distorted to a degree such that the upper surface of the latch bolt 12*a* abuts against the upper edge of the latch retaining aperture of the strike 15.

If the frame structure 1 is distorted in this manner, the clearance between the frame structure 1 and the door 11 becomes uneven, so that the frame structure 1 and the door 11 interfere with each other when the door 11 is swung open. As a result, the door 11 cannot be opened and closed smoothly.

SUMMARY OF THE INVENTION

Accordingly, the object of the present invention is to provide a door apparatus designed so that a frame structure can be set without deformation in a door opening with a door attached to the casing.

A door apparatus according to the present invention, developed in order to achieve the above object, is an apparatus that is set in a door opening in a building wall, and comprises: a frame structure including first and second Vertical frames extending parallel to each other and an upper frame connecting the respective upper ends of the vertical frames; a door fitted in the frame structure and having one side portion corresponding to the first vertical frame and other side portion corresponding to the second vertical frame; at least one hinge swingably connecting the one side portion of the door to the first vertical frame; a lock body provided on the other side portion of the door and having a latch bolt capable of projecting and receding sideways from the other side portion of the door; a strike provided on the second vertical frame and having a latch retaining aperture capable of releasably receiving the latch bolt; and a latch tacker including a latch bolt receiving portion having a shape such that the latch bolt receiving portion can be removably fitted and held in the latch retaining aperture, located in a position opposite the latch bolt when held in the latch retaining aperture so that the latch bolt can be inserted into the latch bolt receiving portion, whereby the latch tacker is restrained from moving at least in a vertical direction by the strike when the latch bolt is in the latch bolt receiving portion.

In the door apparatus constructed in this manner, the first vertical frame of the frame structure and the one side portion of the door are connected by the at least one hinge. The second vertical frame is supported on the latch bolt of the door by means of the latch tacker and the strike. Thus, the frame structure can never be distorted during operation even though the door apparatus is set in the door opening with the door fitted in the casing. The latch tacker is disengaged from the strike when the door is opened after the frame structure is fixed to the inner peripheral surface of the door opening.

In the door apparatus according to the invention, the second vertical frame may be pulled toward the door by binding the entire door apparatus tight by means of a band wound around and across the frame structure and the door. By doing this, the second vertical frame can be prevented from separating from the door during the operation for setting the door apparatus in the door opening, so that the latch tacker can be prevented from being disengaged from the strike. After the frame structure is fixed to the inner peripheral surface of the door opening, the band is cut at a suitable point, and is drawn out from between the frame structure and the inner peripheral surface of the door opening.

An example of the latch tacker includes a body unit having a projection adapted to be supported by the strike when the tacker is interposed between upper and lower edges of the latch retaining aperture of the strike. The body unit has the latch bolt receiving portion that can receive the latch bolt and support upper and lower surfaces of the latch bolt. The latch tacker constructed in this manner can be tacked to the strike by only being fitted into the latch retaining aperture of the strike, and can be easily disengaged from the strike by only being pulled outward.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
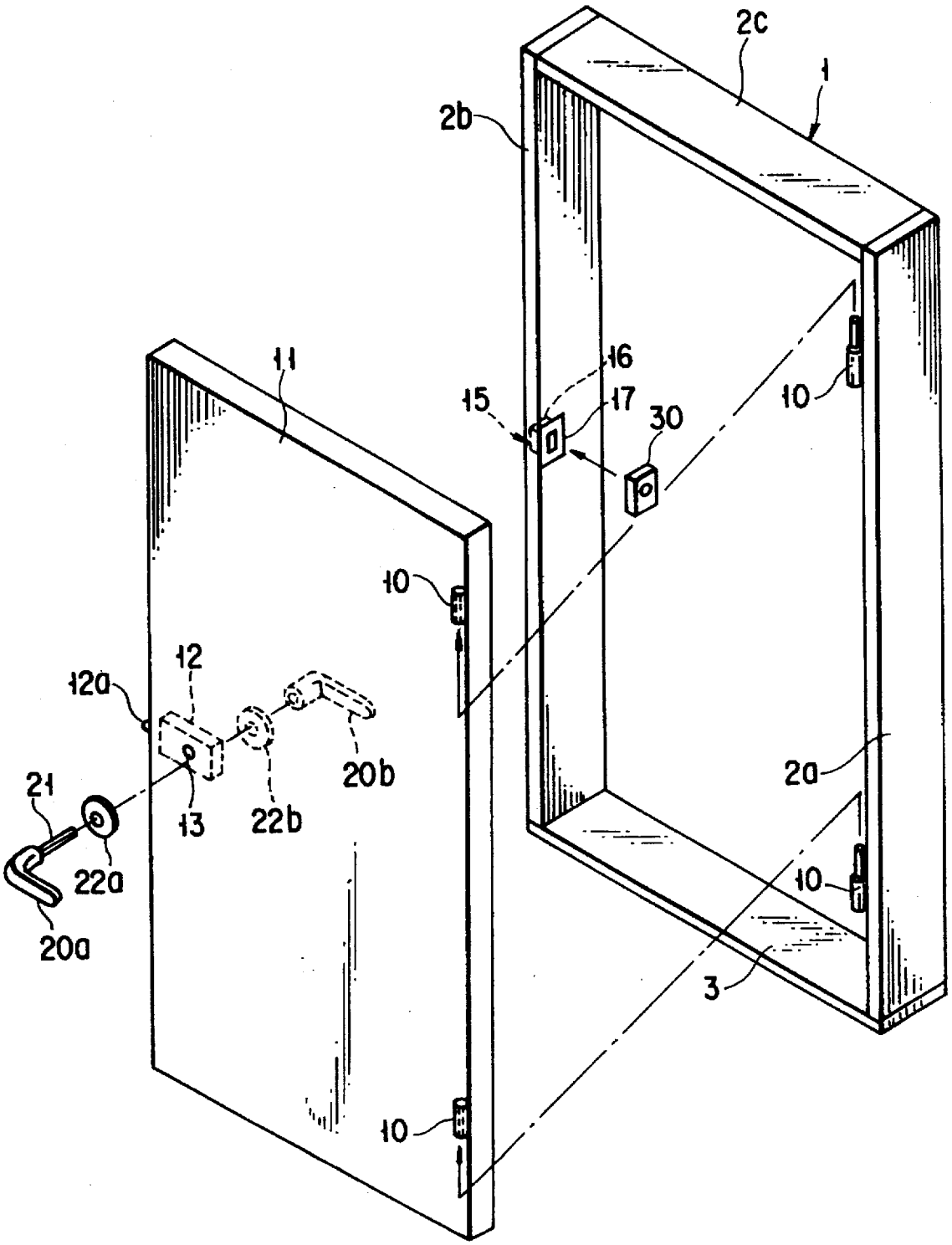
FIG. 1 is an exploded perspective view of a door apparatus according to an embodiment of the present invention.
Figure 2:
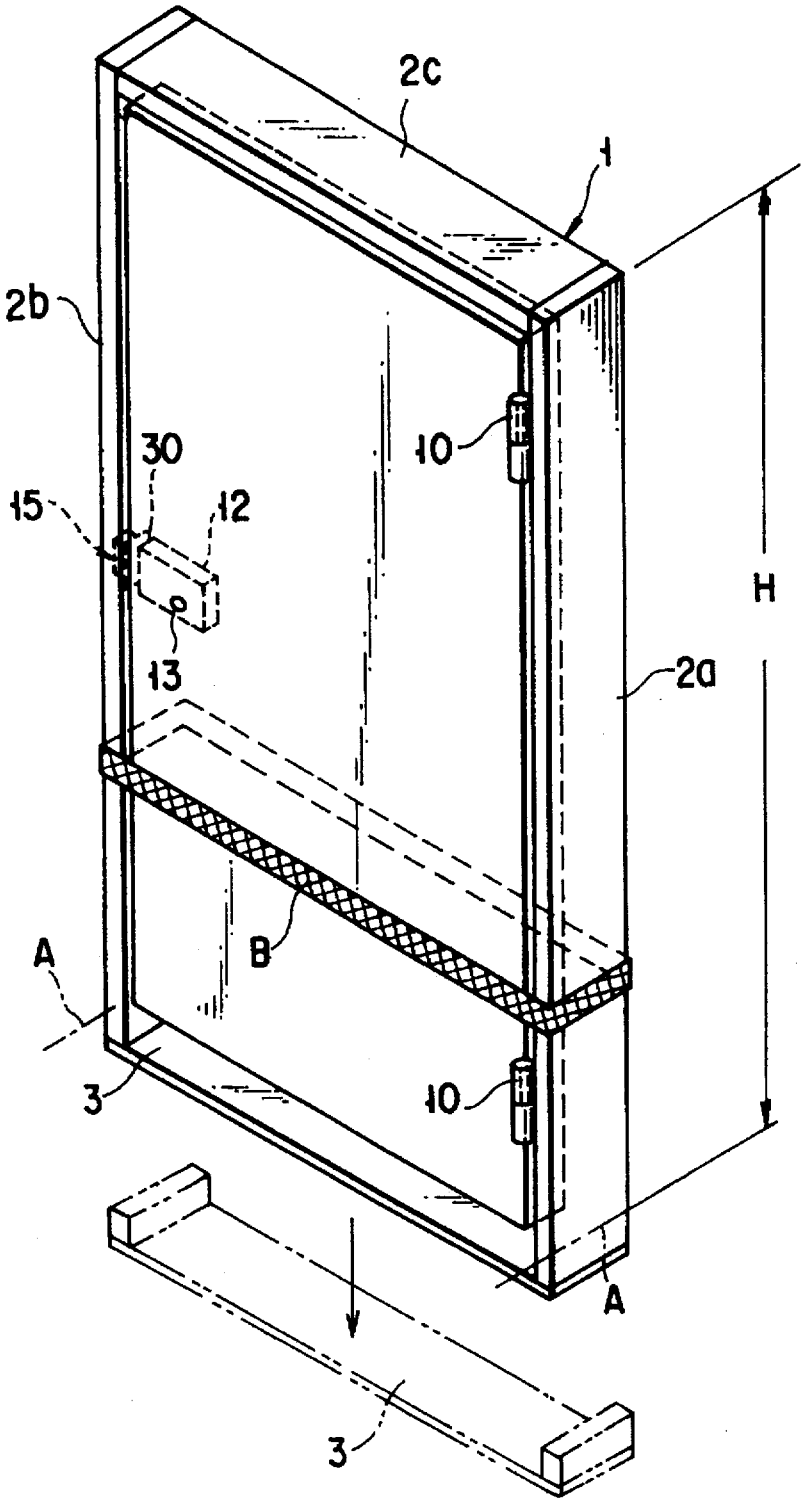
FIG. 2 is a perspective view showing the door apparatus of FIG. 1 with a door set in a casing.

In a door apparatus according to the present invention shown in FIGS. 1 to 5, a frame structure 1 includes a parallel pair of vertical frames 2*a* and 2*b*, right and left, and an upper frame 2*c* connecting the respective upper ends of the frames 2*a* and 2*b*. One side portion of a door 11 is pivotally supported on the first vertical frame 2*a* by means of hinges 10 in two positions, upper and lower. The door 11 can be swung open on this side of FIG. 1. As shown in FIG. 2, the lower end portion of each vertical frame extends below the lower edge of the door 11. Each vertical frame is cut to a length H that is equal to the height of a door opening in the wall. The respective lower ends of the vertical frames 2*a* and 2*b* are connected by means of a waste frame 3.

Figure 3:
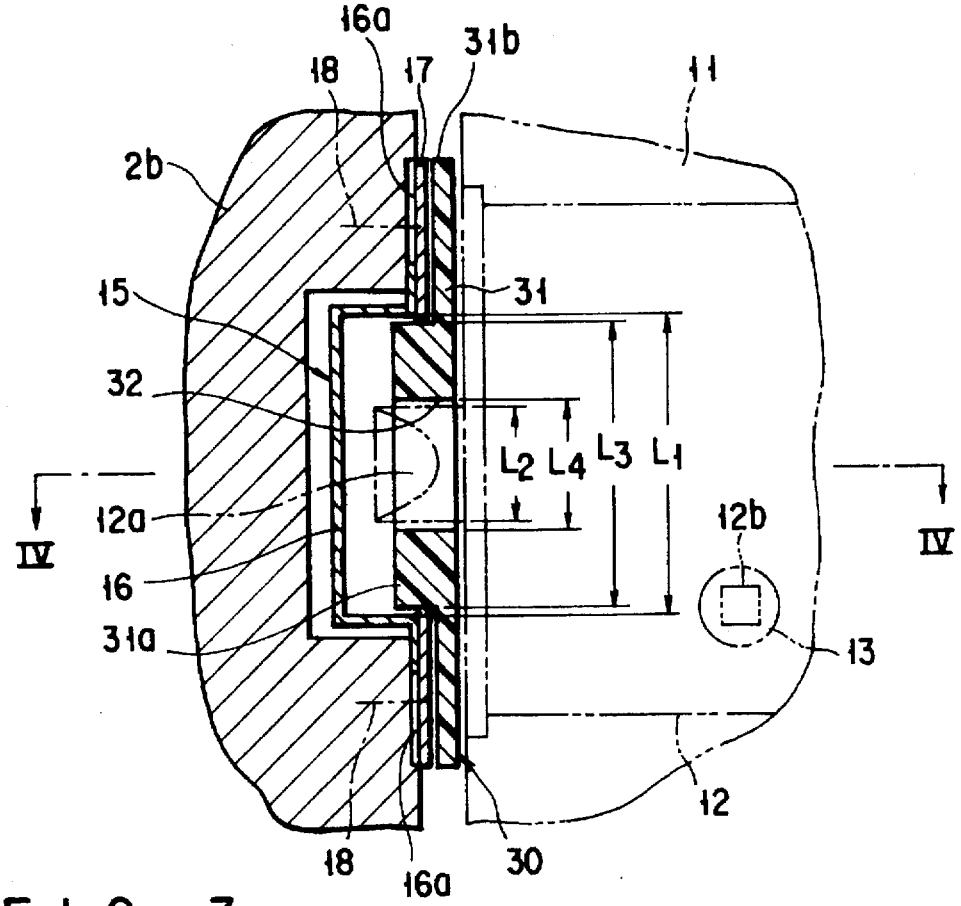
FIG. 3 is a vertical sectional view showing a portion of the frame structure provided with a strike.

A lock body 12 having a latch bolt 12*a* is provided on the other side portion of the door 11. Unlocking handles 20*a* and 20*b* are attached to the outside and inside of the door 11, respectively. An unlocking shaft 21 attached to the one handle 20*a* is passed through a through hole 13 in the door 11. As shown in FIG. 3, the through hole 13 is located in alignment with a shaft hole 12*b* in the lock body 12.

The second vertical frame 2*b* is provided with a strike 15. The strike 15 is situated opposite the latch bolt 12*a*, which can project and recede from a side face of the door 11. The strike 15 is fitted with a latch tacker 30.

Figure 4:
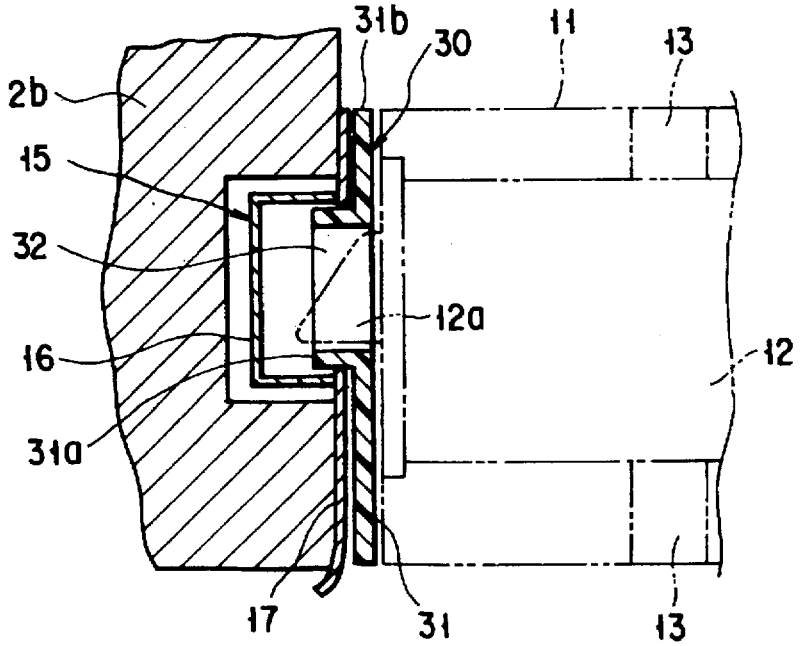
FIG. 4 is a sectional view taken along line IV—IV of FIG. 3.
Figure 5:
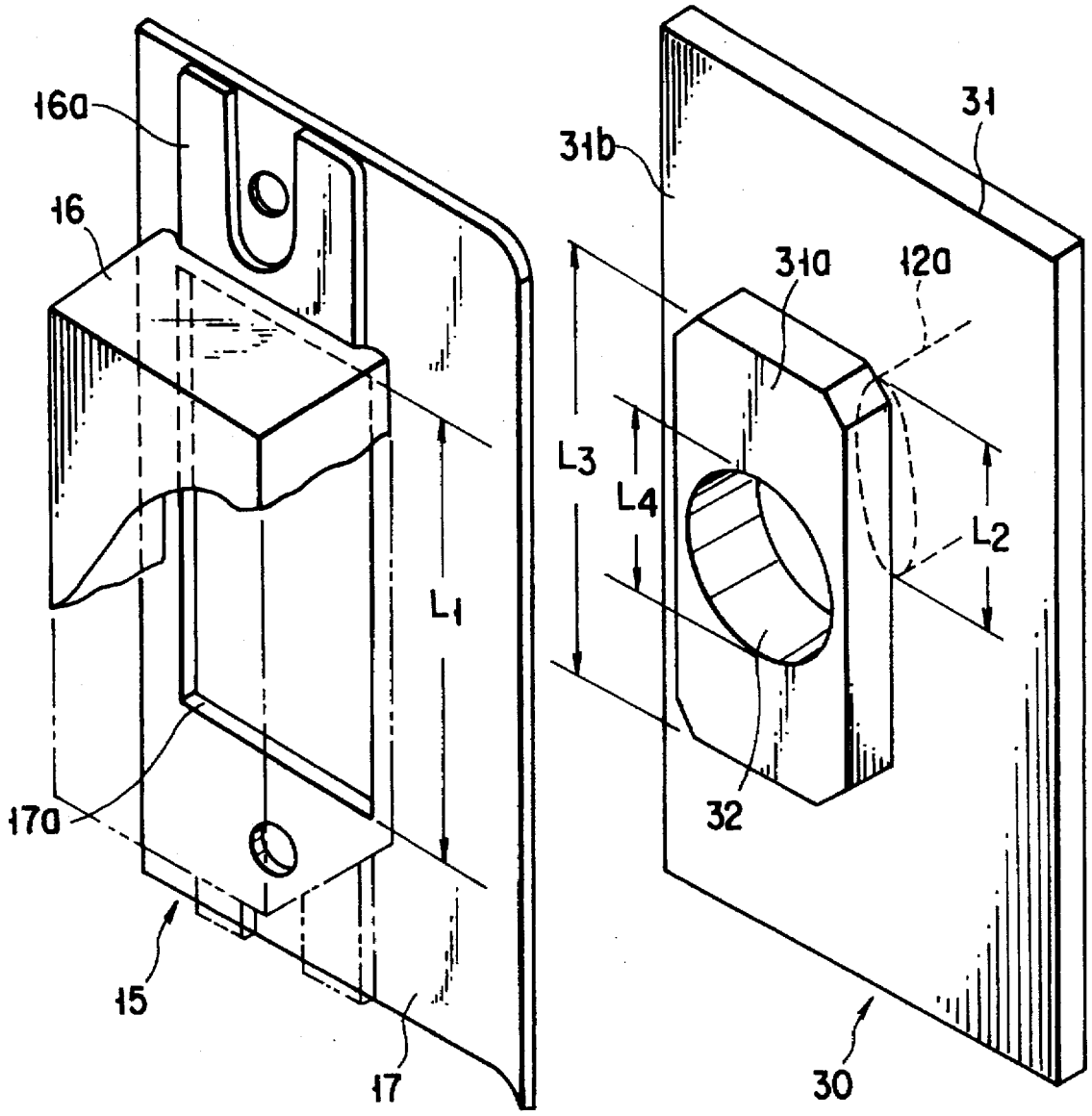
FIG. 5 is a perspective view showing the strike and a latch tacker of the door apparatus of FIG. 1.

As shown in FIGS. 3 to 5, the strike 15 includes a strike box 16 and a strike plate 17. The strike box 16 has an opening on that side thereof which faces the door 11 and upper and lower flange portions on either side of the opening. The strike plate 17 has a latch retaining aperture 17*a* in which the latch bolt 12*a* of the lock body 12 is fitted. A vertical opening width L1 (shown in FIGS. 3 and 5) of the aperture 17*a* is greater enough than a vertical dimension L2 of the latch bolt 12*a* to allow the bolt 12*a* to be fitted in the aperture 17*a* even though the attached strike 15 is vertically dislocated in some measure with respect to the frame structure 1.

The strike box 16 is fitted in a recess that is formed in the second vertical frame 2*b*, and the strike plate 17 is put on the front side of the box 16. The strike plate 17 and vertically extending flange portions 16*a* of the strike box 16 are fixed to the inner surface of the vertical frame 2*b* by means of wood screws 18.

A body unit 31 of the latch tacker 30 includes a planar portion 31*b*, and a projection 31*a* is formed integrally on the back side of the planar portion 31*b*. A circular latch bolt receiving aperture 32 is formed substantially in the center of the projection 31*a*. As shown in FIG. 3, a vertical dimension L3 of the projection 31*a* is a little smaller than the vertical opening width L1 of the latch retaining aperture 17*a* so that the projection 31*a* can be fitted substantially tight in the aperture 17*a*. Thus, the upper and lower ends of the projection 31*a* can engage the upper and lower edges, respectively, of the aperture 17*a*.

The latch bolt receiving aperture 32 penetrates the projection 31*a* in the thickness direction of the body unit 31. A vertical dimension L4 of the aperture 32 is a little greater than the vertical dimension L2 of the latch bolt 12*a*. By fitting the bolt 12*a* into the aperture 32, the strike 15 can be prevented from moving in the vertical direction. The latch tacker 30 according to this embodiment is an integrally molded product of a synthetic resin, such as polyvinyl chloride. The area of the planar portion 31*b* is equal to that of the strike plate 17. The planar portion 31*b* is sandwiched between the strike 15 and the door 11.

The latch tacker 30 is held by the strike 15 in a manner such that the projection 31*a* formed on its body unit 31 is fitted in the latch retaining aperture 17*a* of the strike plate 17. Thus, the latch tacker 30 can be easily attached to the strike 15 by only being fitted into the aperture 17*a*.

The latch bolt 12*a* is fitted into the latch bolt receiving aperture 32 of the latch tacker 30 by closing the door 11 with respect to the frame structure 1 after the tacker 30 is attached to the strike 15. Thereupon, the vertical frame 2*b* is restrained from moving in the vertical direction with respect to the door 11. As shown in FIG. 2, moreover, a band B is wound around and across the door apparatus. As the door apparatus is bound tight with the band B, it is packed up with its second vertical frame 2*b* pulled toward the door 11, and is then shipped together with its accessories. The accessories include doorstops (not shown) to be attached to the respective inner surfaces of the frames 2*a*, 2*b* and 2*c*, front and back curbs (not shown) covering the gap between the frame structure 1 and the inner peripheral surface of the door opening, etc., as well as the handles 20*a* and 20*b*. The band B is a commercially available tape-shaped plastic band for use as a packing band. After the band B is wound tight around the frame structure 1, its opposite end portions are connected to each other by using conventional fixing means, such as a band fastener, welding, etc.

The respective lower end portions of the vertical frames 2*a* and 2*b* extend downward for some extra length from the lower edge of the door 11 so that each vertical frame can be cut to a length corresponding to the height of the door opening in the building wall. The doorstops and curbs as the accessories also have some extra length for allowance such that they can be cut to a length corresponding to the vertical frames 2*a* and 2*b*.

The door apparatus according to the embodiment described above is set in the door opening in the building wall, with the door 11 fitted in the frame structure 1, in the following manner. First, the lower end portion of each of the vertical frames 2*a* and 2*b* is cut off along dashed line A in FIG. 2, depending on the height of the door opening. Then, the door apparatus is fitted into the door opening and positioned. After a liner is driven into the gaps between the respective outer surfaces of the frames 2*a*, 2*b* and 2*c* and the inner peripheral surface of the door opening, the frame structure 1 is fixed to the inner peripheral surface of the door opening by means of wood screws or nails.

In this case, the first vertical frame 2*a* and the door 11 are connected to each other by means of the hinges 10 lest their relative positions be changed, while the relative positions of the second vertical frame 2*b* and the door 11 are maintained by means of the latch tacker 30 and the strike 15. Thus, the frame structure 1 can never be distorted during installation even though the door apparatus is set in the door opening with the door 11 fitted in the frame structure 1.

When the respective lower end portions of the vertical frames 2*a* and 2*b* are cut off to adjust the length of each vertical frame, the waste frame 3, which connects the lower end of the frames 2*a* and 2*b*, is removed. In such a case, the vertical frames 2*a* of the conventional door apparatus becomes unstable. However, the door apparatus according to this embodiment is designed so that the second vertical frame 2*b* is anchored to the latch bolt 12*a* by means of the latch tacker 30, and the frame 2*b* is pulled toward the door 11 by the band B. Accordingly, the vertical frame 2*b* can be prevented from separating from the door 11 during the operation for setting the door apparatus in the door opening. Thus, the vertical frame 2*b* can be securely kept fixed to the door 11 without the possibility of the latch tacker 30 being disengaged from the strike 15.

After the frame structure 1 is fixed to the inner peripheral surface of the door opening, the band B is cut at any desired point, and is drawn out from between the frame structure 1 and the inner peripheral surface of the door opening in a manner such that one end side of the band B is pulled. The removal of the band B can be facilitated by keeping the liner away from the band B or by providing the liner with a groove for the passage of the band B. By doing this, the band B can be smoothly removed even after the door apparatus is fixed to the door opening in the wall.

After the band B is removed, the lock body 12 is released, the door 11 is swung open, and the latch tacker 30 is disengaged from the strike 15. Since the latch tacker 30 is only fitted in the latch retaining aperture 17*a* of the strike 15, it can be easily removed from the strike 15 by only being pulled outward. The lock body 12 can be released by inserting an unlocking tool or the unlocking shaft 21 of the handle 20*a* into the shaft hole 12*b* in the lock body 12, and then rotating it in an unlocking direction.

After the door apparatus is fixed to the door opening, the doorstops are attached individually to the respective inner surfaces of the frames 2*a*, 2*b* and 2*c*. Also, the front and back curbs are attached to the frame structure 1 or the peripheral edge of the door opening. Further, the handles 20*a* and 20*b* are attached to the outside and inside of the door 11, respectively, whereupon the installation of the door apparatus in the door opening is finished.

Since the door apparatus can be set in the door opening with the door 11 attached to the frame structure 1, the installation can be carried out easily and quickly. Since the frame structure 1 can be set in the door opening without deformation during the installation work, an appropriate clearance can be secured between the door 11 and the frame structure 1.

Figure 6:
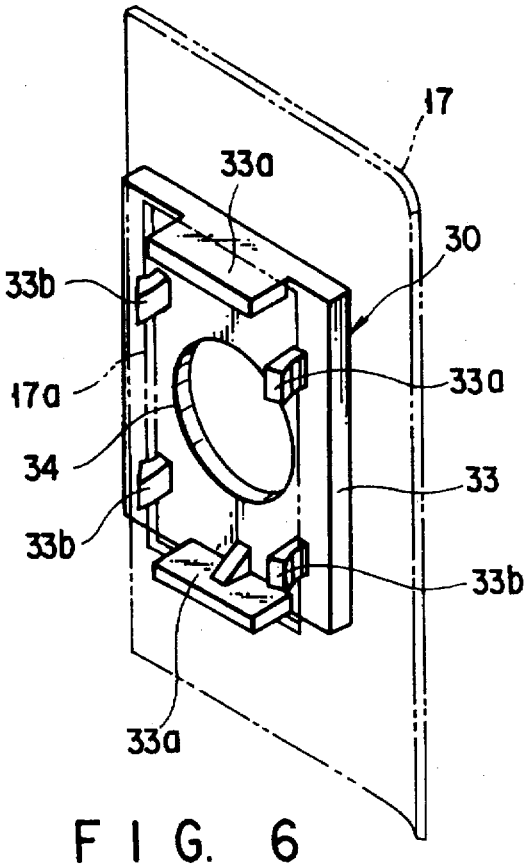
FIG. 6 is a perspective view showing a first modification of the latch tacker.

Since the latch tacker 30 must only be designed so that the body unit 31, which is held between the upper and lower edges of the latch retaining aperture 17*a*, is provided with a latch bolt receiving portion that can hold the latch bolt 12*a*, it may be in any other form than the one according to the embodiment described above. A modification of the latch tacker 30 shown in FIG. 6 is an integrally molded product of a synthetic resin, such as polyvinyl chloride. In this latch tacker 30, a pair of first retaining pieces 33*a*, upper and lower, and two pairs of second retaining pieces 33*b*, right and left, are formed integrally on the back of a planar body unit 33, which is in contact with the outer surface of the strike plate 17. The first retaining pieces 33*a* engage the upper and lower edges of the latch retaining aperture 17*a*, individually. The second retaining pieces 33*b* are adapted to engage their corresponding opposite side edges of the aperture 17*a*. A latch bolt receiving aperture 34 substantially penetrates the center of the body unit 33 in the thickness direction thereof.

Figure 7:
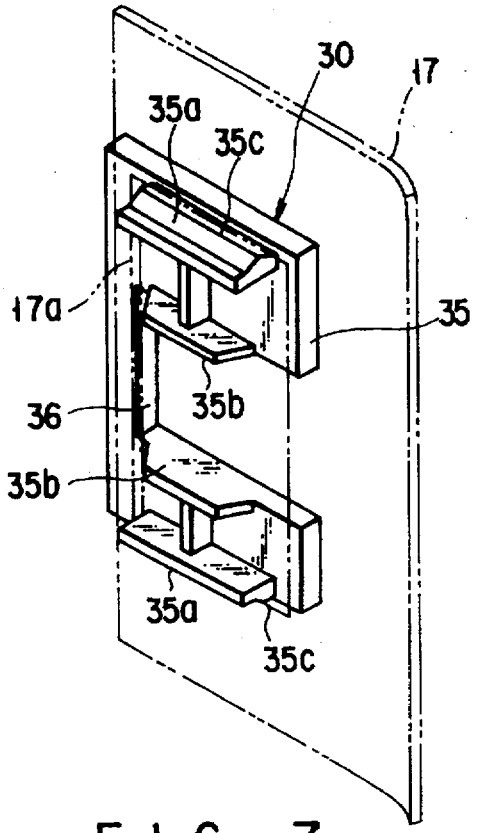
FIG. 7 is a perspective view showing a second modification of the latch tacker.

A modification of the latch tacker 30 shown in FIG. 7 is also an integrally molded product of a synthetic resin. In this latch tacker 30, a pair of retaining pieces 35*a*, upper and lower, are formed integrally on the back of a planar body unit 35, which is in contact with the outer surface of the strike plate 17. These retaining pieces 35*a* engage the upper and lower edges of the latch retaining aperture 17*a*, individually. A latch bolt receiving slit 36 substantially penetrates the center of the body unit 35 in the thickness direction thereof. The slit 36 opens on one side of the body unit 35. Each retaining piece 35*a* is formed having a hook portion 35*c* that engages its corresponding edge of the retaining aperture 17*a*. In FIG. 7, numeral 35*b* denotes a flange portion that strengthens each horizontal edge of the latch bolt receiving slit 36.

Figure 8:
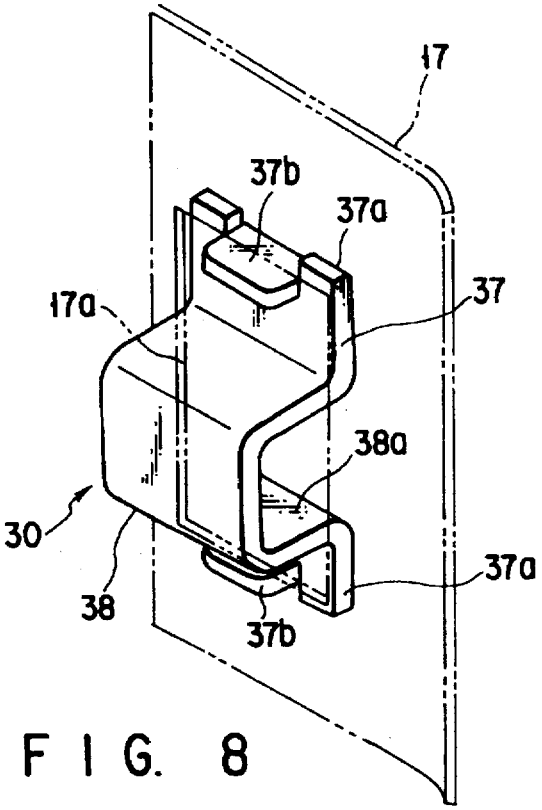
FIG. 8 is a perspective view showing a third modification of the latch tacker.

A modification of the latch tacker 30 shown in FIG. 8 includes a body unit 37 that is formed of a pressed metal plate. A collar portion 37*a* is formed on each of the upper and lower ends of the body unit 37, and is in contact with the outer surface of the strike plate 17. A retaining piece 37*b* is provided at the end of each collar portion 37*a*. The two opposite retaining pieces 37*b* engage the upper and lower edges of the latch retaining aperture 17*a*, individually. A U-shaped portion 38 is provided at the central portion of the body unit 37, and it can be fitted in the aperture 17*a*. A recess 38*a* on the inner surface side of the U-shaped portion 38 serves as a latch bolt receiving portion.

Figure 9:
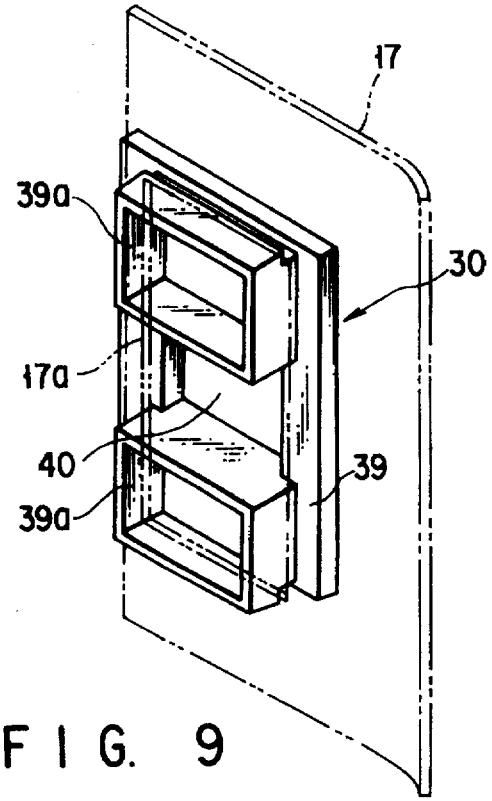
FIG. 9 is a perspective view showing a fourth modification of the latch tacker.
Figure 10:
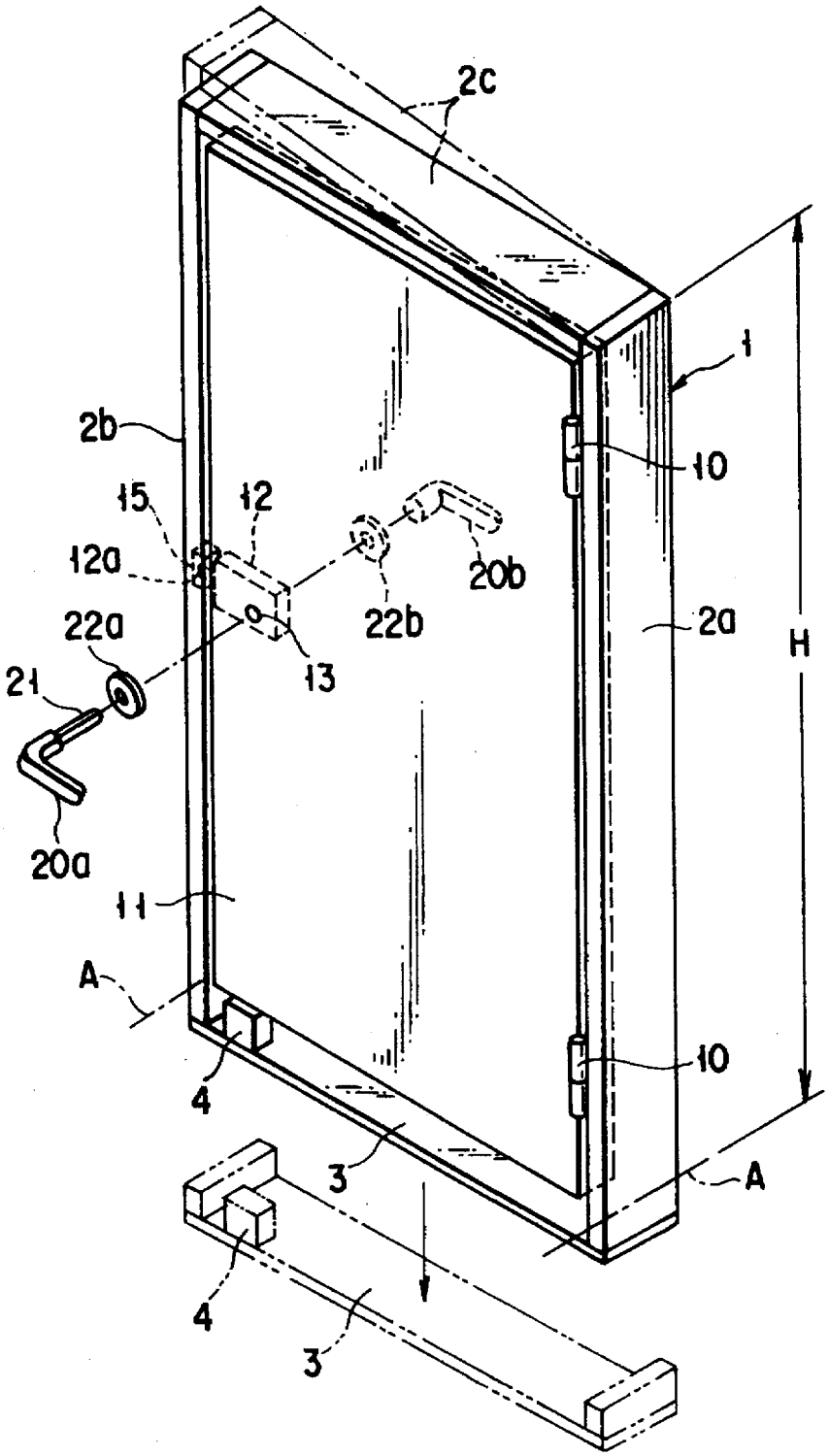
FIG. 10 (PRIOR ART)
FIG. 10 is a perspective view of a conventional door apparatus.

A modification of the latch tacker 30 shown in FIG. 9 is an integrally molded product of a synthetic resin, such as polyvinyl chloride. A body unit 39 of this latch tacker 30 is provided integrally with a pair of projections 39*a*, upper and lower, in the form of a rectangular tube each. These projections 39*a* can be fitted in the upper and lower parts of the latch retaining aperture 17*a*, individually. A rectangular latch bolt receiving aperture 40 is defined between the two projections 39*a*.

In the embodiment described herein, the frame structure 1 is bound tight with the band B, so that the waste frame 3 may be omitted. The band B need not always be used in the case where the respective lower ends of the vertical frames 2*a* and 2*b* are connected by means of the waste frame 3. In the case where the band B is not used, an operator cuts off the lower end portions of the frames 2*a* and 2*b*, and then fits the door apparatus into the door opening while pressing the second vertical frame 2*b* against its corresponding side face of the door 11.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A door apparatus set in a door opening in a building wall, the door apparatus comprising:

a frame structure including first and second vertical frames extending parallel to each other, and an upper frame connecting respective upper ends of the vertical frames;

a door fitted in the frame structure and having one side portion corresponding to the first vertical frame and an other side portion corresponding to the second vertical frame;

at least one hinge swingably connecting the one side portion of the door to the first vertical frame;

a lock body provided on the other side portion of the door and having a latch bolt capable of projecting and receding sideways from the other side portion of the door;

a strike provided on the second vertical frame and having a latch retaining aperture capable of releasably receiving the latch bolt; and a latch tacker including a latch bolt receiving portion having a shape such that the latch bolt receiving portion can be removably fitted and held in the latch retaining aperture, located in a position opposite the latch bolt when held in the latch retaining aperture so that the latch bolt can be inserted into the latch bolt receiving portion, whereby the latch tacker is restrained from moving at least in a vertical direction by the strike when the latch bolt is in the latch bolt receiving portion.

2. A door apparatus according to claim 1, further comprising a band wound around and across the frame structure and the door, the band pulling the second vertical frame toward the other side portion of the door.

3. A door apparatus according to claim 1, wherein said latch tacker includes a body unit having a projection adapted to be supported by the strike when the latch tacker is interposed between upper and lower edges of the latch retaining aperture of the strike, the body unit having the latch bolt receiving portion capable of receiving the latch bolt and supporting upper and lower surfaces of the latch bolt.

4. A door apparatus according to claim 3, wherein said body unit of said latch tacker is formed of a synthetic resin, and includes a portion having a latch bolt receiving aperture large enough to receive the latch bolt, and a planar portion formed integrally with the latch bolt receiving portion and extending in a vertical direction of the body unit so that the planar portion can be sandwiched between the strike and the door.

5. A door apparatus according to claim 3, wherein there are relations $L2<L4<L3<L1$, where L1 is a vertical opening width of the latch retaining aperture of the strike, L2 is a vertical dimension of the latch bolt, L3 is a vertical dimension of a projection of the latch tacker, and L4 is a vertical opening width of the latch bolt receiving portion.

6. A door apparatus according to claim 3, wherein said body unit of said latch racket is formed of a synthetic resin, and includes a portion having a latch bolt receiving groove large enough to receive the latch bolt, and a planar portion formed integrally with the latch bolt receiving portion and extending in a vertical direction of the body unit so that the planar portion can be sandwiched between the strike and the door.

7. A door apparatus according to claim 1, wherein the at least one hinge comprises a plurality of hinges swingably connecting the one side portion of the door to the first vertical frame.

* * * * *